United States Patent [19]

McGill

[11] 3,964,549

[45] June 22, 1976

[54] FIRE SPRINKLER AND CEILING PANEL ASSEMBLY

[76] Inventor: Paul F. McGill, 2298 Country Club Ave., Omaha, Nebr. 68104

[22] Filed: Nov. 8, 1974

[21] Appl. No.: 522,256

[52] U.S. Cl. ..... 169/37; 126/317

[51] Int. Cl.[2] ..... A62C 37/10

[58] Field of Search ..... 169/37, 38, 39, 40, 169/41; 239/208, 209, 288, 288.3, 288.5; 248/27, 345, 44; 126/315, 317

[56] References Cited

UNITED STATES PATENTS

| | | | |
|---|---|---|---|
| 1,229,061 | 6/1917 | Gaynor | 126/317 |
| 1,335,730 | 4/1920 | Gaynor | 126/317 |
| 1,904,681 | 4/1933 | Frantz | 126/317 X |
| 2,871,953 | 2/1959 | Bray | 169/37 |
| 3,389,884 | 6/1968 | Ault | 169/37 X |
| 3,451,483 | 6/1969 | Van Houette et al. | 169/39 |
| 3,807,503 | 4/1974 | Iasillo, Sr. | 169/37 |

*Primary Examiner*—Evon C. Blunk
*Assistant Examiner*—Michael Mar
*Attorney, Agent, or Firm*—Henderson, Strom & Sturm

[57] ABSTRACT

A fire sprinkler and panel ceiling assembly having a panel with a vertical sprinkler head passage therethrough large enough to allow the panel to be tilted with respect to a sprinkler pipe sufficiently to allow the panel to pass downwardly beyond its supporting flanges and over the sprinkler head, and a cover extending around the pipe above the sprinkler head and covering the panel head passage hole, the cover having a removable part to permit its removal from the pipe without the necessity of the removal of the head.

A cover, as described, having two identical interfitting sections, each section being formed of one piece of material.

7 Claims, 6 Drawing Figures

FIRE SPRINKLER AND CEILING PANEL ASSEMBLY

FIELD OF THE INVENTION

This invention is in the field of fire sprinkler systems of buildings in which a fire sprinkler head is disposed beneath a removable ceiling panel with the pipe leading to the sprinkler head extending through the panel.

DESCRIPTION OF THE PRIOR ART

In fire extinguishing systems, as described, it has been impossible to remove a panel through which a sprinkler head supporting pipe extends, in most cases, because the hole through the panel is so small that it is not large enough to permit the panel to be passed downwardly over the sprinkler head.

In such cases, removal of the sprinkler head is impractical, although it would otherwise be a way to get it out of the way for the removal and replacement of the panel.

The reason the removal of the sprinkler head is impractical is because doing so would cause all the sprinklers in the system to start to sprinkle, damaging furniture and equipment throughout the entire building in many cases.

In order to shut down the sprinkler system, a building management is required by the insurance company to take time to notify the fire department, particularly the fire alarm company that has instruments which monitor the building in question, as is a nuisance and a time-cost.

However, the biggest nuisance and time-cost is the bother of having to shut down the entire sprinkler system.

Apart from these nuisances, an even more important factor is the danger involved that a fire might break out in the building during the time the sprinkler system is shut down.

The man hours required for draining the system are approximately three man-hours, in some buildings. The long time involved increases the danger that a fire will break out while there is no protection from the system.

In most locations, an expensive skilled journeyman plumber is required, because of union regulations, to come to unscrew the sprinkler itself, even though such unscrewing could be done by an unskilled person.

Many of these sprinkler systems are installed in high-rise buildings, too high for the highest fire engine ladder trucks to rescue people from the upper floors, so that personnel sometimes just jump to their deaths from flaming windows.

Some buildings have as many people working in them as would populate a small rural town. Although some buildings have ten thousand or more people in them at once; buildings having as many as two thousand people in them at once are even quite common. Fire protection in such cases is vital.

Sprinkler systems are very valuable because great destruction of material and life can occur before a fire department can even reach the fire and begin to work on it.

It is to be expected that a building that has a system such as proposed in this invention could conceivably obtain lower insurance rates.

It is common for ceiling panels to need replacement, and it has been the most common practice to destroy the ceiling panel by breaking or cutting it, or else draining the entire sprinkling system. The replacement of a panel is impossible without shutting down a sprinkler system, also. For that reason, sometimes a panel is cut into two parts, and then put in place. However, the joint between the two parts is then very visible and is a ragged cut edge, most unsightly. It is common practice to have a solid cover disposed between a sprinkler head and a ceiling panel for covering the hole through the ceiling panel. Such covers are solid rings, and there is no way to remove them from the pipe on which they are received without removing the sprinkler head itself, as involves the complete shutting down of the sprinkler system as described.

Never to my knowledge has there been a two-part cover used above a sprinkler head in such a panel system. It is the object of this invention to provide a two-part cover, the parts of which can be easily removed from one another to get it out of the way, the cover being large enough to cover a opening through the panel which is itself large enough to allow the panel to be moved downwardly across the sprinkler head while held at an angle to the horizontal.

In the prior art, it has not been uncommon for building management to have a large hole cut around the outside of the conventional small one-piece decorative cover in order to allow the panel to be taken down, with the result that thereafter the large hole simply exists in its unsightly, uncovered state, extending around the small conventional decorative cover.

Another prior art practice has been to do the same way as described, but to cover the exposed part of the panel hole which extends around the small decorative cover with a flat piece of plastic of "C"-shape, but simulated ring-shape, having one side split, the plastic being flexible enough to allow the flat plastic ring to be passed over the pipe and downwardly against the upper side of the conventional small decorative cover beneath the panel for the purpose of covering the open hole with a piece of plastic; however, such a piece of plastic is thought to be very unsightly because such a flat disc slides quickly out of place and is soon off-center with respect to the standard decorative cover. However, an additional reason that such plastic discs are considered unsightly is because they are usually made of white plastic to go with a white panel, but are necessarily of a different texture from, and usually not of matching color with the panel itself.

In the prior art example just described, when such a ring is off center, it is not only unsightly for that reason, but in addition, it usually exposes a portion of the hole itself.

SUMMARY OF THE INVENTION

A fire sprinkler and panel ceiling assembly having a panel with a vertical sprinkler head passage therethrough large enough to allow the panel to be tilted with respect to a sprinkler pipe sufficiently to allow the panel to pass downwardly beyond its supporting flanges of a panel-supporting framework and over a sprinkler head therebeneath supported on a pipe extending through the sprinkler head passage in the panel, and a cover extending around the pipe above the sprinkler head and covering the panel head passage hole, the cover having a removable part permitting the removal of the cover from said pipe without the necessity of removal of the head and without the necessity of the passage of said cover over either said sprinkler head or an opposite end of said pipe at such time as the removal part of the cover has been removed.

A further object is to provide a cover construction for use in the position described having a first part having a main portion with a concave undersurface and having a pipe reception indentation disposed substantially centrally at one side thereof, as seen in bottom plan view, for receiving a part of the pipe, the other side of the main portion having a generally convex edge configuration as seen in bottom plan view, the first part having an offset portion disposed in use position offset upwardly from the main portion and projecting from the one side thereof on one side of the pipe indentation, the offset portion having an edge farthest from the pipe indentation, the farthest edge described being offset toward said indentation from the adjacent part of the generally convex edge of the main portion, the cover having a second part having a shape describable in the same way as the first part above described, the two cover parts being disposed their said one sides opposite each other and with their pipe indentations disposed opposite each other, and their concave sides facing upwardly so that the indentations form a pipe opening, the second part having its offset portion on an opposite side of said pipe opening from the offset portion of the first part, the parts each having a tab disposed on one side of said pipe opening and each having a tab-receiving notch on a side of said pipe opening which is opposite to the tab, said tabs extending upwardly through the notches of the other cover part respectively whereby said cover parts are substantially limited as regards horizontal movements with respect to each other.

The notches and the tabs snugly fit each other respectively and the walls of the pipe opening closely fit the pipe whereby the cover parts cannot be moved with respect to each other sufficiently to permit the tabs to move horizontally with respect to the walls of their notches respectively sufficiently to move out of their notches respectively.

DESCRIPTION OF THE PREFERRED EMBODIMENT

Figure 1:
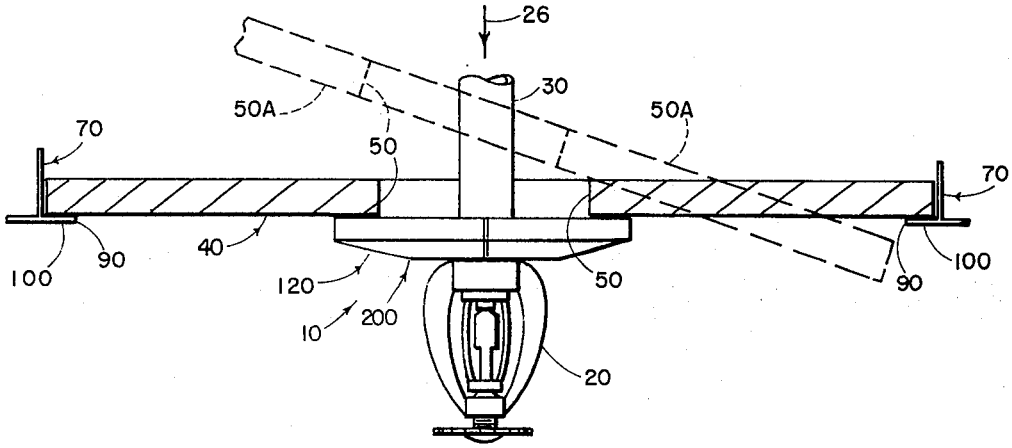
FIG. 1 is a side elevation of a ceiling panel shown in a cross-section taken directly through the center of a head passage hole therethrough, flange portions of a framework holding opposite edges of the panel being shown with the cover of this invention beneath the panel supported by a sprinkler head attached to a pipe extending through the head passage hole of the panel, an intermediate position of the panel disposed tilted with respect to the vertical as shown in dotted lines in a position it is in just before being moved downwardly in the direction of an arrow past the sprinkler head.

The fire sprinkler and panel ceiling assembly of this invention is generally indicated at 10 in FIG. 1 and comprises a fire sprinkler head 20 having a construction of any conventional or other nature for spreading a fire prevention fluid over a wide area in a building, a vertical pipe 30 attached to and carrying sprinkler fluid to the head 20 is shown thereabove.

A horizontal ceiling panel 40 having a sprinkler head passage 50 extending vertically therethrough is shown in horizontal position of use in full lines in FIG. 1.

A panel supporting framework or assembly 70 having a panel opening 90 extending vertically therethrough is provided.

The panel supporting assembly 70 has horizontally extending panel-engaging flange portions 100 extending under opposite edges of the panel and supporting the panel and disposed at edges of the panel opening 90 and defining edges of the panel opening 90.

The head passage hole 50 is large enough to permit a tilting of the panel to the dotted line position 50A of FIG. 1 and to permit a passing of the panel downwardly in the direction of the arrow 26 over the head 20 for removal of the panel 40 from the remainder of the assembly without a cutting or a breaking of the panel, as has so often been done in the prior art.

This invention provides a panel hole cover generally indicated at 120 in FIG. 1 having a pipe-receiving opening therethrough receiving the pipe 30, the size of the cover 120 being sufficiently large as measured in a horizontal plane as to substantially cover the head passage hole 50 of the panel as seen from therebeneath, except for the portion of the pipe-receiving opening 50 which is occupied by the pipe 30 itself.

Figure 4:
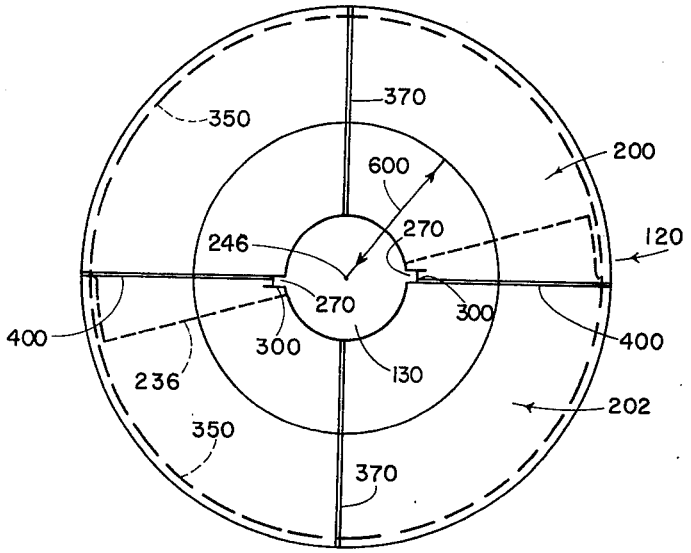
FIG. 4 is a bottom plan view of the sprinkler head passage hole cover of this invention with certain parts thereof showing in dotted lines.

The cover 120 having a plurality of separate parts, and more particularly two separate and identical parts generally indicated at 200 and 202 in FIG. 4.

Figure 2:
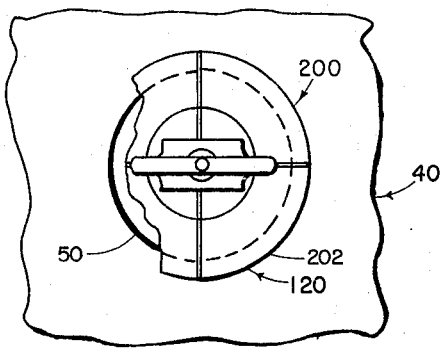
FIG. 2 is a bottom plan view of a portion of the panel of FIG. 1 showing the sprinkler head and cover, a portion of the cover being broken away for showing the position of the sprinkler head passage hole which is shown partially in full and partially in dotted lines.
Figure 3:
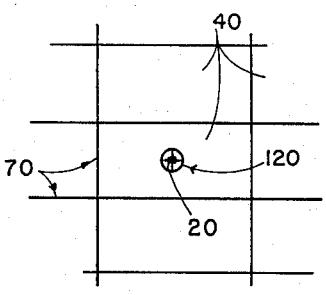
FIG. 3 is a view looking upwardly at a ceiling, the portion of the ceiling showing some ceiling panels partially and others completely and one with a sprinkler head assembly and cover mounted therebeneath.
Figure 5:
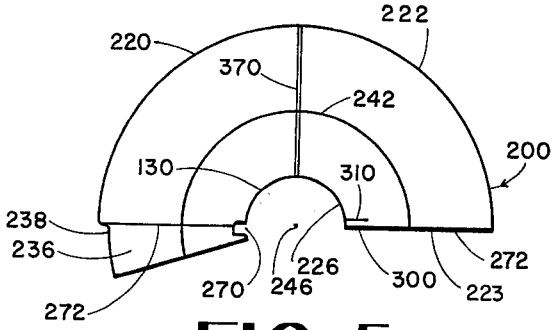
FIG. 5 is a bottom plan view of one of the two main identical parts of the cover of FIG. 4.

The panel hole cover of this invention is shown in FIG. 2 to have two separate parts 200 and 202, shown in detail in FIG. 4, the two parts or sections 200 and 202 being identical, whereby the one part shown at 200 in FIG. 5 illustrates the detail of construction of both parts. At the time the two parts are first made by stamping and before a second step about to be described herein, the two parts look as they do in FIG. 5, each having a main portion 220 in the shape of half of a circle on an outer edge 222 and in the shape of half of a smaller diametered circle along an edge 226 of a semi-circular opening 130, earlier mentioned.

Each main portion 220 joins an offset portion 236, which latter, in top view, has an outer edge 238 which is inset inwardly a slight distance from the edge 222 so as to fit closely against the inner side of the other half section 202 of the cover 120. The offset portion 236, as best seen in FIG. 6, is disposed parallel to and immediately beneath the remaining attached main portion 220 so as to be received snugly against the underside of the opposite cover section 202 after assembly.

The main portion 220 of the cover section 200 can be seen to have a planar upper portion 242 which latter is horizontal in use, a vertical outer edge portion 244 which is semi-cylindrical in shape extending about a vertical axis 246, and a circular ring-shaped portion 246 which interconnects the portions 242 and 244 and is of one piece of material therewith.

Figure 6:
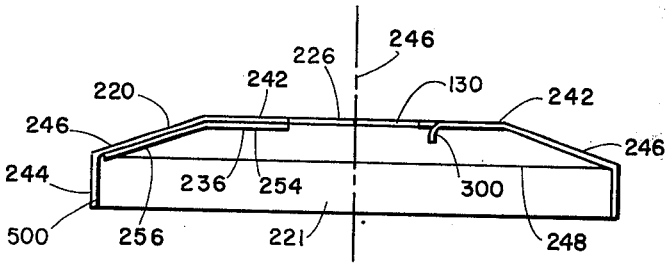
FIG. 6 is a view showing the cover part of FIG. 5 as it would be seen from the underneath on the sheet shown, FIG. 6 showing the cover part in an inverted position as compared with the use position of FIG. 1.

The lower edge of the inner side of the portion 246 makes a semi-circular line 248, visible in FIG. 6.

The offset portion 236 has a upper portion 254 which is disposed horizontal and has an upper surface disposed immediately below or in the same plane with the lower surface of the planar upper portion 242.

The portion 254 is connected to and of one piece with a downwardly and outwardly inclining portion 256 which is parallel to and disposed immediately below the portion 246.

The entire offset portion 236 is substantially of a wedge-shape, narrower toward the axis 246 and has a notch 270 disposed in its side which is closest to and joining the main section 220, the notch can be as small as an eighth of an inch across, as measured at a right angle to the straight edge 272, or rather straight edges 272, of the two parts of the inner side of the main portion 220 which are disposed innermost as regards the total cover 120 and which are adapted to be disposed adjacent corresponding edges 272 of the opposite panel cover section 202. The edges 272 are disposed on each side of the panel opening 130 for receiving the pipe 30.

The notch 270 can be of a very small depth, such as one-eighth of an inch or less, and is adapted to receive a tab 300 formed from the same piece of material as the remainder of the cover section 300 and formed by the provision of a slit 310 extending into the horizontal upper portion 242 from the cover pipe opening 130. The slit 310 extends parallel to the edge 272 to which it is adjacent and is spaced therefrom a distance of one-eighth of an inch, approximately.

The purpose of the tab 300 is so that when it is bent downwardly from the position shown in FIG. 5 so that its outer end extends vertically in the position shown in FIG. 6, the tab can be received between the walls of the notch 270 of the opposite half section 202 of the total cover 120 when the two parts 200 and 202 of the cover 120 are assembled, as shown in FIG. 4, in which it is to be seen that a tab 300 of the part 202 is extending downwardly on the left-hand side of the total cover 120 through a notch 270 of the cover part 200.

In FIG. 4 on the right side, the tab 300 of the cover part 200 is shown extending downwardly into the notch 270 of the cover part 202.

In FIG. 4, the inner wall 350 of each cover part 200 or 202 can be seen in dotted lines.

Also in FIG. 4 an ornamental crevice or groove 370 can be seen in the top side of the cover 200 and it is of a small depth and is for the purpose of appearance only and has no function, being for cooperation in appearance with the joinder line 400 of the two parts 200 and 202 so as to give a criss-cross line appearance instead of a single line appearance.

The other cover part 202 also has a ornamental crevice 370.

Throughout this application identical parts or portions of the two cover parts 200 and 202 will be given identical numbers.

As thus described, it can be seen that the cover has a plurality of separate parts 200 and 202 specifically, so that the cover 120 can be removed from the pipe by movements of the parts of the cover without taking the cover endwise across either the head 20 or the pipe 30.

As best understood from FIG. 4, it will be seen that to remove the cover all one needs to do is to push the panel 40 upwardly a very short distance allowiing, for example, the right-hand side of the cover part 200 to be moved downwardly (recognizing that FIG. 4 is looking at the cover from the bottom) while at the same time causing the opposite end of the cover part 200 to move upwardly, in other words, a twisting motion with respect to the cover part 202. Such a motion will disengage both of the tabs from their respective openings. If desired, both parts of the cover 200 and 202 can be twisted simultaneously with respect to each other and with respect to the pipe in substantially the manner described and for removing the tabs from the openings.

The farthest edges 238 of each of the offset portions are each disposed close enough to the certain upper terminal edge portion 500 of the other part respectively as to cooperate with the depth of the notches 270 and with the thickness of the tabs 300 so as to prevent the parts 200 and 202 from coming apart by mere horizontal movement.

For the latter to be possible, the main portion of each part 200 or 202 has a certain upper terminal edge portion 500 which is disposed opposite to the farthest edge portion 238 of the offset portion 236 of which it is a part, the certain terminal edge portion being disposed transversely to each of the offset portions 236, and preferably being disposed vertically in a vertical segment of a vertical cylinder with its axis at 246.

I claim:

1. A fire sprinkler and panel ceiling assembly comprising: a fire sprinkler head having a construction for spreading a fire prevention fluid over a wide area, a vertical pipe attached to and carrying said fluid to said head, a horizontal ceiling panel having a head passage extending vertically therethrough, a panel supporting assembly having a panel opening extending generally vertically therethrough, said supporting assembly having panel-engaging portions extending under edges of said panel and supporting said panel and disposed at edges of said panel opening, and said head passage hole being large enough to permit a tilting and a rotating of said panel with respect to said panel opening and a passing of said panel down over said head for removal of said panel from the remainder of said assembly, and a panel hole cover having a perforation therethrough receiving said pipe and of a size as measured in a horizontal plane which latter size is large enough to substantially cover said head passage hole as seen from therebeneath except for the portion of said perforation occupied by said pipe, said cover having a plurality of separable parts so that said cover can be removed from said pipe by movements of certain parts of said cover in directions laterally of said vertical pipe, disconnectable means holding said cover parts together in a manner permitting sufficient separation of said cover parts for removing said cover from said pipe in directions other than vertically off of an upper portion of said pipe; said cover comprising a first part having a main portion having a concave undersurface and having a pipe reception indentation disposed substantially centrally of one side thereof as seen in bottom plan view for receiving a part of said pipe, the other side of said main portion having a generally convex edge configuration as seen in bottom plan view, said first part having an offset portion disposed in use position offset upwardly from said main portion and projecting from said one side thereof on one side of said pipe indentation, said offset portion having an edge farthest from said pipe indentation, said farthest edge being offset toward said indentation from the adjacent part of the said generally convex edge of said main portion, said cover having a second part having a shape describable in the same way said first part is above described, said two cover parts being disposed with their said one sides adjacent each other and their pipe indentations adjacent each other, and their concave sides both facing upwardly so that said indentations from a pipe opening, said second part having its offset portion on an opposite side of said pipe opening from the said offset portion of said first part, said parts each having a tab attached thereto and disposed on one side of said pipe opening and each having a tab-receiving notch on a side of said pipe opening which is opposite to said tab, said tabs extending downwardly through said notches respectively whereby said cover parts are substantially limited as regards horizontal movements with respect to each other.

2. The fire sprinkler and ceiling panel assembly of claim 1 in which said notches and tabs snugly fit each other respectively.

3. The fire sprinkler and ceiling panel assembly of claim 3 in which the walls of said pipe opening closely fit said pipe.

4. The fire sprinkler and ceiling panel assembly of claim 1 in which the said perforation is substantially equal to the diameter of said pipe to closely fit said pipe.

5. The fire sprinkler and ceiling panel assembly of claim 1, said cover being upheld by engagement of its parts with said head.

6. A cover for a ceiling panel fire sprinkler pipe hole, said cover comprising a first part having a main portion having a concave undersurface and having a pipe reception indentation disposed substantially centrally of one side thereof as seen in bottom plan view for receiving a part of a vertical pipe, the other side of said main portion having a generally convex edge configuration as seen in bottom plan view, said first part having an offset portion disposed in use position offset upwardly from said main portion and projecting from said one side thereof on one side of said pipe indentation, said offset portion having an edge farthest from said pipe indentation, said farthest edge being offset toward said indentation from the adjacent part of the said generally convex edge of said main portion, said cover having a second part having a shape describable in the same way said first part is above described, said two cover parts being disposed with their said one sides adjacent each other and their pipe indentations opposite each other, and their concave sides both facing upwardly so that said indentations form a pipe opening, said second part having its offset portion on an opposite side of said pipe opening from the said offset portion of said first part, said parts each having a tab attached thereto and disposed on one side of said pipe opening and each having a tab-receiving notch on a side of said pipe opening which is opposite to said tab, said tabs extending upwardly through said notches respectively whereby said cover parts are substantially limited as regards horizontal movements with respect to each other.

7. The fire sprinkler and ceiling panel assembly of claim 7, said notches and tabs sufficiently snugly fitting each other respectively and the walls of said pipe opening sufficiently closely fitting said pipe that said covers cannot be moved in a manner for causing said tabs to move horizontally outwardly of the respective notches in which they are received.

* * * * *